United States Patent [19]

Ihrman

[11] 4,445,590

[45] May 1, 1984

[54] SCAFFOLD PLANK CONNECTING ARRANGEMENT

[75] Inventor: Carl-Bertil Ihrman, Jönköping, Sweden

[73] Assignee: Floby Durk, Floby, Sweden

[21] Appl. No.: 362,052

[22] Filed: Mar. 26, 1982

[30] Foreign Application Priority Data

Mar. 30, 1981 [SE] Sweden ..... 8102009

[51] Int. Cl.[3] ..... E04G 5/08; E04G 7/20

[52] U.S. Cl. ..... 182/222; 182/119; 403/393

[58] Field of Search ..... 182/222, 223, 119; 403/393, 206, 215; 24/201 HE, 226

[56] References Cited

U.S. PATENT DOCUMENTS

| | | | |
|---|---|---|---|
| 1,523,438 | 1/1925 | McMillan | 403/393 |
| 1,843,925 | 2/1932 | Kempf | 403/393 |
| 1,980,154 | 11/1934 | Coe | 403/393 |
| 2,658,690 | 11/1953 | Hill | 24/226 |
| 2,953,340 | 9/1960 | Skubic | 182/179 |
| 2,981,365 | 4/1961 | Olsen | 182/223 |

FOREIGN PATENT DOCUMENTS

| | | | |
|---|---|---|---|
| 2542271 | 10/1976 | Fed. Rep. of Germany . | |
| 2916236 | 10/1980 | Fed. Rep. of Germany . | |
| 866047 | 6/1941 | France | 24/201 HE |
| 2485598 | 12/1981 | France | 182/222 |
| 384893 | 5/1976 | Sweden . | |
| 586335 | 2/1977 | Switzerland . | |

*Primary Examiner*—Reinaldo P. Machado
*Assistant Examiner*—Alvin Chin-Shue
*Attorney, Agent, or Firm*—Cushman, Darby & Cushman

[57] ABSTRACT

A scaffold plank correction arrangement comprises a pair of identical connectors, each having a horizontal flat portion attached to a plank and a folded-down tongue portion integrally formed therewith. A transverse slit is provided in the flat portion of each connector, which slit extends parallelly to the common boundary between the flat portion and the tongue. When the connectors are placed in an overlapping relationship, the tongue of one connector protrudes through the slit in the other connector whereby a direct connection is formed between the ends of two adjacent planks (FIG. 2).

12 Claims, 10 Drawing Figures

SCAFFOLD PLANK CONNECTING ARRANGEMENT

BACKGROUND OF THE INVENTION

The present invention relates to scaffolding and, more particularly, to means for connecting scaffolding planks together in an end-to-end-relationship.

DESCRIPTION OF THE PRIOR ART

It is known to connect adjacent planks of a scaffolding platform in an end-to-end manner by providing the appropriate ends of the planks with a plurality of projecting hooks. The hooks from opposed ends of adjacent planks are hooked over a single support cross bar forming part of the scaffolding arrangement. Thus, the hooks from the two planks are offset from one another and, as one looks along the bar, the hooks from the two planks alternate with one another.

Such an arrangement has certain disadvantages. Firstly, gaps are left between the ends of the planks in the region of the cross bar. Debris is liable to collect in these gaps. Moreover, a workman may stumble in the region of these gaps. Another disadvantage is that the planks are only indirectly connected to one another and cannot, therefore, be moved together with any ease.

OBJECTS OF THE INVENTION

The present invention seeks to provide a plank connecting arrangement which is of a simple and reliable design and in which the abovementioned disadvantages are eliminated or at least minimized. The invention also seeks to provide an arrangement in which a substantially continuous smooth transition area is formed between the planks. Still further, the present invention seeks to provide an arrangement in which the planks are connected directly to one another so that adjacent planks can be moved and laid down together, independently of the cross bars, such as is necessary during erection and longitudinal adjustment of the scaffolding.

SUMMARY OF THE INVENTION

According to the present invention, there is provided a scaffold plank connection arrangement comprising a pair of substantially identical connector members, each members being attachable to the end of a scaffold plank, each connector comprising a plate having a horizontal flat portion, the width of the flat portion being so selected as to correspond to the width of the plank to which it is to be affixed, the flat portion, when affixed, extending beyond the end of the plank in the longitudinal direction thereof, and a downwardly directed flat tongue portion, the tongue portion being integrally formed with the horizontal plate portion and sharing a common edge therewith, the tongue having a smaller width than and being located centrally of the horizontal plate portion, an elongate through-slit being formed in the horizontal plate portion, the slit extending parallel to, and substantially coextensively with the common edge such that, in use when the two connectors are placed in an overlapping relationship, the tongue of the upper connector protrudes through the slit of the lower connector so as to interconnect the two connectors and the planks to which they are affixed.

BRIEF DESCRIPTION OF THE DRAWINGS

The invention will be further described, by way of example, with reference to the accompanying drawings, in which.

DESCRIPTION OF THE PREFERRED EMBODIMENTS

Figure 1:
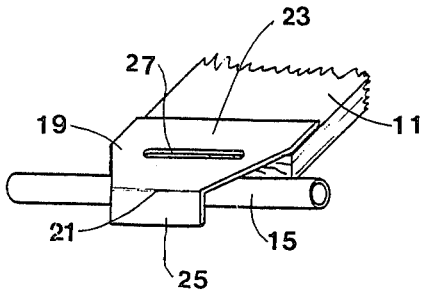
FIGS. 1 and 2 show, diagrammatically a first embodiment of a connector and the joint formed by a pair of such connectors respectively.
Figure 2:
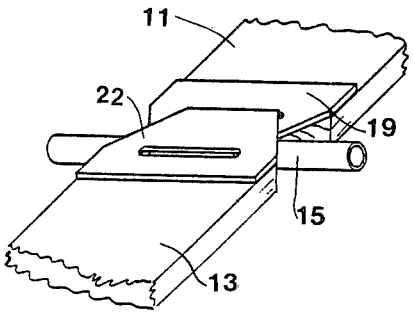

In FIGS. 1 and 2, the numerals 11 and 13 designate two planks forming part of a scaffolding platform. The term "planks" as used herein includes within its scope not only wooden boards but also metallic beams having a channelled profile. In use, the planks are to be connected to one another in an end-to-end relationship and are also to be detachably affixed to a horizontal cross rod 15 forming part of the scaffolding arrangement.

A connecting arrangement in accordance with the present invention for connecting two planks together comprises a pair of substantially identical connector members 19, 22, one connector member being attached to an end portion of each of the planks to be connected. In the case of wooden planks the attachment of the member on the plank may be effected by glueing and/or nailing or, in the case of metallic planks, by welding.

As shown in FIG. 1, each connector comprises a metallic plate having a horizontal flat portion 23 and a tongue portion 25 extending at substantially 90° to the flat portion. The line defining the join between the portions 23 and 25 is referenced 21. The opposed edge of the portion 23 remote from the line 21 is affixed to the plank and the tongue portion 25 extends downwardly therefrom and terminates in a free end portion. When affixed to the plank, the flat portion 23 overlies the plank and extends beyond the end thereof. The portion 23 has a substantially constant width portion, which is substantially the same width as the plank and a portion which tapers inwardly substantially symmetrically, towards the tongue portion 25. The tongue portion is therefore located substantially centrally of the connector and has a smaller width than the constant width portion of the flat portion 23.

In the horizontal plate portion 23, there is provided an elongate through slit 27 which extends parallel to the fold line 21, that is to say, in the transverse direction of the planking. This slit is spaced from the line 21 at a distance therefrom at least equal to the diameter of the cross bar 15. The slit 27 is substantially coextensive with the fold 21, that is to say both are of approximately the same length and their centre points lie in the longitudinal centre plane of the connector. Thus, when the connectors are placed in an overlapping relation, as is shown in FIG. 2, the tongue 25 of one connector 22 fits into the slit 27 of the other connector 19. Alternatively, the tongue of the connector 19 could be fitted into the slit 27 of the connector 22. It is therefore irrelevant as to which plate is located uppermost. The planks are then connected directly to each other, and also connected to the cross bar 15 because the two tongues embrace the bar from opposite sides. The above described connection arrangement means that the space between the ends of the planks are almost completely covered and provide a relatively smooth transition between adjacent planks thereby minimising the chances of injury or damage to workmen or materials. The joints of the planking need not, in fact coincide with the position of the cross bars of the scaffolding.

Figure 3:
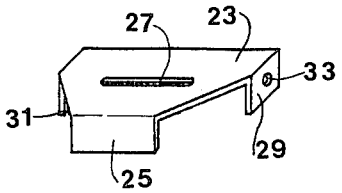
FIG. 3 shows diagrammatically a slightly modified form of connector.

In the modification shown in FIG. 3 the connector is reinforced by the provision of vertical webs 29,31 which extend along the opposed longitudinal edges of the horizontal plate portion 23 of each connector. Preferably these webs are formed simply by folding the longitudinal edge regions of the flat portions 23 downwardly through an angle of substantially 90 degrees. These webs embrace the opposed edges of the plank in its end region and can be fastened thereto by means of nails or screws inserted through appropriately located apertures 33.

Figure 4:
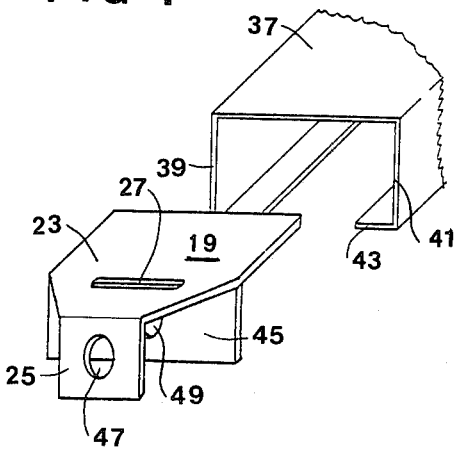
FIG. 4 is a perspective view of one end of a steel plank and a connector in accordance with the present invention which is suitable for insertion therein.
Figure 5:
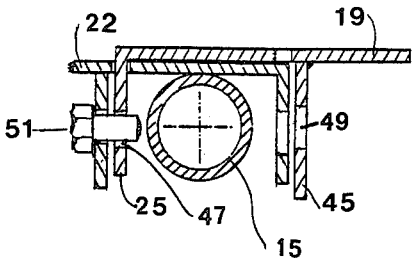
FIG. 5 is a cross-sectional view of the joint produced by the connector shown in FIG. 4, FIGS. 6 and 7 each show a connecting arrangement in which means are provided for locking the connectors together.

FIG. 4 shows the end of a steel plank having an inverted U-shaped profile. The plank has a smooth or idented horizontal upper surface 37, vertical side flanges 39,41 and inwardly directed bottom flanges 43. A connector of the type shown in FIG. 3 can be inserted into the channel-like interior of the end of the plank and can be attached thereto by means of spot welds connecting the webs 29,31 of the connector to the internal surface of the flanges 39,41. The connector shown in FIG. 4 is of a somewhat modified design compared with those described hereinbefore. In this modified design, a vertical web 45 is welded to the underside of the horizontal plate portion 23 and extends over substantially the entire width thereof. The slit 27, in such connector, is situated between the tongue 25 and the transverse web 45, so that it is not covered when the connector is inserted into the end of the plank. This is ensured because the edges of the web 45 contact the inner surfaces of the plank flanges 39,41 and are welded thereto. An additional feature of such design is the provision of holes 47 and 49 in the tongue 25 and in the transverse web 45, respectively. These holes lie on a common line extending in the longitudinal direction of the planks. When the connectors are connected together, as shown in FIG. 5, hole 47 in one plank is aligned with the hole 49 in the other plank, so that a locking member, such as a bolt 51, can be inserted through these holes 47 and 49. This secures the joint against unintentional disengagement.

Figure 6:
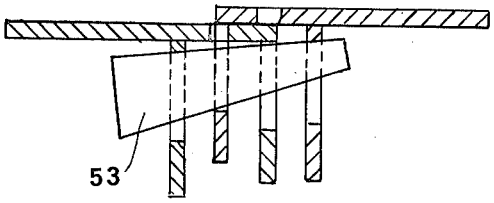

To make such joint rigid, which is necessary if the joint is not supported by a cross bar, the locking member can be arranged to cooperate with more than two holes. As shown in FIG. 6, the locking member may be in the form of a wedge 53 which is inserted through four holes in the tongues and webs. When the wedge is driven-in longitudinally to its maximum possible extent, it bears upon the edges of two of the holes in opposite directions and presses the connectors into tight engagement with one another.

Figure 7:
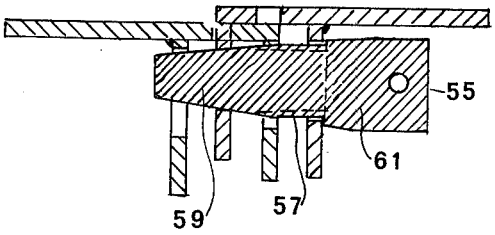

In FIG. 7, the locking member is shown in the form of a bolt 55 having a central cylindrical threaded portion 57 and neighboring smooth conical portions 59 and 61 at the tip and head ends thereof.

When the bolt is being rotated, the threads thereof engage the rim of one of the holes so that the bolt is advanced axially. In its terminal position the thread bears against the rim of three or even four holes, whereby the joint is reinforced. Accordingly, the joint can be located at a point distant from a support cross bar of the scaffolding.

Figure 8:
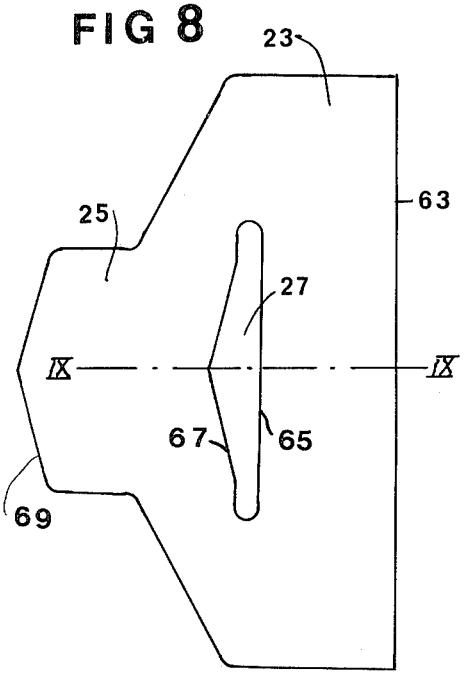
FIGS. 8,9 and 10 show, respectively, a plan view and a cross-sectional view of a modified form of connector and a joint produced by two such connectors.
Figure 10:
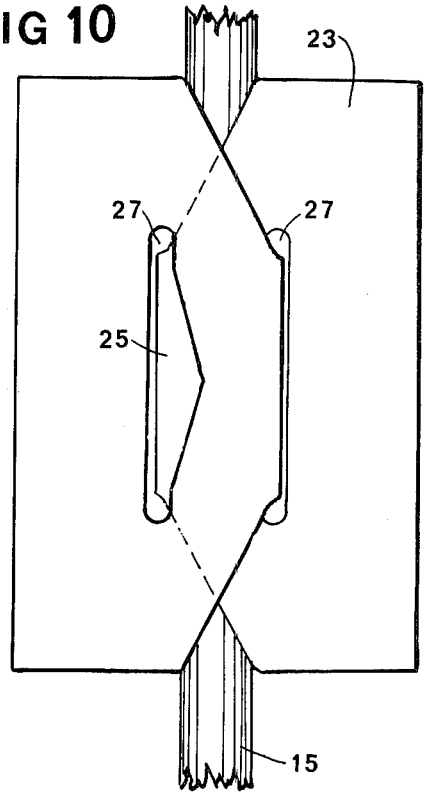
Figure 9:
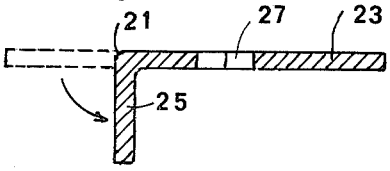

FIGS. 8 and 9 show a connector in greater detail and having certain additional features added FIG. 8 shows a plan view of the connector before the tongue is folded over and FIG. 9 is a vertical cross-sectional view taken along the centre plane IX—IX in FIG. 8 after the tongue 25 has been folded over. All parts of the connector are symmetrical about the centre plane IX—IX. The width of the vertical plate part 23 is ideally 220 mm and the width of the tongue is from 80 to 100 mm. The fold 21 and the slit 27 are slightly longer than the width of the tongue, so that there is a play at the ends of the slit when the tongue of the connector mounted on the adjacent plank is inserted therein. One edge 65 of the slit is straight and the other 67 is bent, so that the slit is wider in its central region than at its ends. The tongue has a correspondingly shaped bent edge portion 69. Due to these features, the insertion of the tongue into the slit is greatly facilitated, as can be seen from FIG. 10.

I claim:

1. A scaffold plank connection arrangement comprising:

a pair of substantially identical connector members, each member for attachment to the end of a scaffold plank;

each connector member comprising: a plate with opposed longitudinal edges having a flat portion disposed in a first plane; a flat tongue portion integrally formed with said plate portion and sharing a common edge therewith, said tongue portion disposed in a second plane substantially perpendicular to said first plane; and an elongated slit being centrally located with respect to said flat portion and extending in said flat plate portion in a dimension parallel to said second plane, said slit being spaced from said common edge and extending parallel to, and substantially co-extensively, with said common edge; and in use said first plane being substantially horizontal, and the width of said flat plate portion corresponding to the width of a plank to which it is to be attached, with said second plane being generally vertical and said flat tongue portion extending downwardly from said common edge; said tongue having a smaller width than, and being centrally located with respect to, said horizontal plate portion so that in use when said connector members are placed in overlapping relationship said tongue portion of the upper of said connector members protrudes through the slit of the lower of said connector members whereby said connector members, and the planks to which they are attached, are inter-connected.

2. An arrangement as claimed in claim 1, wherein the length of the slit is selected to be as long as or slightly longer than the common edge the ends of the slit and of the common edge being disposed symmetrically of, and at the same mutual distance from, the longitudinal centre line of the plate.

3. An arrangement as claimed in claim 1, characterised in that the distance between the slit and the common edge is selected to correspond to the diameter of a cross rod forming part of the scaffolding arrangement and supporting the planks, such that, in use, the cross rod is located between the tongues of the two connectors.

4. An arrangement as claimed in claim 3, wherein vertical webs are integrally formed with the opposed longitudinal edges of the horizontal plate portion of each connector for the webs in use, connecting each connector to the opposed edges of the plank to which the connector is attached.

5. An arrangement as claimed in claim 1, wherein a transversely disposed vertical web extends downwardly from the underside of the horizontal plate portion on the side of the slit remote from the tongue.

6. An arrangement as claimed in claim 5, characterised in that the distance between the slit and the common edge is selected to correspond to the diameter of a cross rod forming part of the scaffolding arrangement and supporting the planks, such that, in use, the cross rod is located between the tongues of the two connectors.

7. An arrangement as claimed in claim 5, wherein vertical webs are integrally formed with the opposed longitudinal edges of the horizontal plate portion of each connector for the webs in use, connecting each connector to the opposed edges of the plank to which the connector is attached.

8. An arrangement as claimed in claim 5, wherein holes are provided in the tongue and in the transverse web of each connector, the holes, in use, being aligned in the longitudinal direction of the planks, a locking member being inserted through two or more of the holes.

9. An arrangement as claimed in claim 8, wherein the locking member is in the form of a wedge inserted through all four holes two such holes being formed in each connector.

10. An arrangement as claimed in claim 8, wherein the locking member is in the form of a bolt having a central cylindrical threaded portion and conical end portions, the bolt being inserted into the four holes formed in the tongues and the transverse webs of the connectors and being axially displaceable by engagement of the threaded portion with the rim of at least one of the holes.

11. An arrangement as claimed in claim 1, wherein vertical webs are integrally formed with the opposed longitudinal edges of the horizontal plate portion of each connector for the webs in use, connecting each connector to the opposed edges of the plank to which the connector is attached.

12. An arrangement as claimed in claim 1, characterised in that the distance between the slit and the common edge is selected to correspond to the diameter of a cross rod forming part of the scaffolding arrangement and supporting the planks, such that, in use, the cross rod is located between the tongues of the two connectors.

* * * * *